US010299346B2

(12) United States Patent
Gao et al.

(10) Patent No.: US 10,299,346 B2
(45) Date of Patent: May 21, 2019

(54) SYSTEM AND METHOD FOR MONITORING BACK LIGHT MODULE, AND A DISPLAY APPARATUS

(71) Applicant: BOE TECHNOLOGY GROUP CO., LTD., Beijing (CN)

(72) Inventors: Yankai Gao, Beijing (CN); Chul Gyu Jung, Beijing (CN); Cheng-Te Lai, Beijing (CN); Chengqi Zhou, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/223,498

(22) Filed: Jul. 29, 2016

(65) Prior Publication Data

US 2017/0273160 A1 Sep. 21, 2017

(30) Foreign Application Priority Data

Mar. 16, 2016 (CN) ..... 2016 1 0151476

(51) Int. Cl.
*H05B 37/02* (2006.01)

(52) U.S. Cl.
CPC ..... *H05B 37/0227* (2013.01)

(58) Field of Classification Search
CPC combination set(s) only.
See application file for complete search history.

(56) References Cited

U.S. PATENT DOCUMENTS

| | | | | |
|---|---|---|---|---|
| 9,530,360 | B2 * | 12/2016 | Matsui | G09G 3/3413 |
| 2010/0245400 | A1 | 9/2010 | Nakahata et al. | |

FOREIGN PATENT DOCUMENTS

| | | | |
|---|---|---|---|
| CN | 101145332 | A | 3/2008 |
| CN | 201562442 | U | 8/2010 |
| CN | 101871888 | A | 10/2010 |
| CN | 201910955 | U | 7/2011 |
| CN | 102682720 | A | 9/2012 |
| CN | 103399661 | A | 11/2013 |
| CN | 103701984 | A | 4/2014 |
| CN | 104123109 | A | 10/2014 |

OTHER PUBLICATIONS

China First Office Action, Application No. 201610151476.4, dated Sep. 26, 2017, 19 pps.: with English translation.
China Third Office Action, Application No. 201610151476.4, dated Oct. 8, 2018, 17 pps.: with English translation.

* cited by examiner

*Primary Examiner* — Douglas W Owens
*Assistant Examiner* — Jianzi Chen
(74) *Attorney, Agent, or Firm* — Armstrong Teasdale LLP

(57) ABSTRACT

A system for monitoring a back light module is provided. The system includes an obtaining unit configured to obtain an intensity of output light from the back light module, a detection unit configured to detect whether the intensity of the output light from the back light module is greater than a preset value, and a control unit configured to control the back light module to reduce the intensity of the output light in response to detecting that the intensity of the output light is greater than the preset value, such that the reduced intensity of the output light is equal to or greater than the preset value.

9 Claims, 3 Drawing Sheets

SYSTEM AND METHOD FOR MONITORING BACK LIGHT MODULE, AND A DISPLAY APPARATUS

CROSS REFERENCE TO RELATED APPLICATION

This application claims the benefit and priority of Chinese Patent Application No. 201610151476.4 filed on Mar. 16, 2016, the entire content of which is incorporated by reference herein.

BACKGROUND

The present disclosure relates to display technology, and more particularly, to a system and method for monitoring a back light module, and a related apparatus.

Usually, after a back light module is activated, an intensity of output light (also called "intensity of back light") from the back light module is rapidly increased above a preset value, and then slowly decreased and maintained at the preset value, as shown in FIG. 1. As the intensity of back light is above the preset value within the time period it is increased and decreased, the back light module may waste many electric energies, and cause some pixels to be saturated.

Generally, the back light module may be used as a light source that provides output light to a panel of a mobile device. Since the panel may be activated and deactivated by a user of the mobile device frequently, the back light module may also be activated and deactivated frequently, and thus the back light module may waste more energies. In addition, the battery capacity of the mobile device is limited, and thus, the energy waste may be more serious.

BRIEF DESCRIPTION

According to an aspect, there is provided a system for monitoring a back light module. The system includes an obtaining unit, a detection unit, and a control unit. The obtaining unit is configured to obtain an intensity of output light from the back light module. The detection unit is configured to detect whether the intensity of the output light from the back light module is greater than a preset value. The control unit is configured to control the back light module to reduce the intensity of output light in response to the intensity of the output light is greater than the preset value, such that the reduced intensity of the output light is equal to or greater than the preset value.

In an embodiment of the present disclosure, the detection unit is configured to detect whether the intensity of the output light from the back light module is greater than the preset value at an interval of a preset period.

In an embodiment of the present disclosure, the preset period is from 8 to 12 milliseconds.

In an embodiment of the present disclosure, the detection unit is configured to detect whether the intensity of the output light from the back light module is greater than the preset value within a preset time period since the back light module is activated.

In an embodiment of the present disclosure, the system further includes a recording unit and a computation unit. The recording unit is configured to record, after the back light module is activated, a first time point at which the intensity of the output light is equal to the preset value and a time duration in which the intensity of the output light is greater than the preset value. The computation unit is configured to compute, based on the number of the recordings by the recording unit, the recorded first time points and time durations, an average of the first time points and an average time duration. The preset time period is represented by the average of the first time points and the average time duration.

In an embodiment of the present disclosure, the preset time period is 5 minutes.

According to another aspect, there is provided a display apparatus. The display apparatus includes a back light module and the above-mentioned system for monitoring back light module.

According to still another aspect, there is provided a method for monitoring a back light module. In this method, an intensity of output light from the back light module is obtained. Then it is detected whether the intensity of the output light from the back light module is greater than a preset value. Then, the back light module is controlled to reduce the intensity of the back light in response to the intensity of the output light is greater than the preset value, such that the reduced intensity of the output light is equal to or greater than the preset value.

In an embodiment of the present disclosure, it is detected whether the intensity of the output light from the back light module is greater than the preset value at an interval of a preset period.

In an embodiment of the present disclosure, it is detected whether the intensity of the output light from the back light module is greater than the preset value within a preset time period since the back light module is activated.

In an embodiment of the present disclosure, a first time point at which the intensity of the output light is equal to the preset value and a time duration in which the intensity of the output light is greater than the preset value are recorded after the back light module is activated. After that, an average of the first time points and an average time duration are computed based on the number of the recordings, the recorded first time points and time durations. The preset time period is represented by the average of the first time points and the average time duration.

BRIEF DESCRIPTION OF THE DRAWINGS

The advantages and other features of various embodiments will become more apparent from the following disclosure and claims. The following non-restrictive description of example embodiments is given for the purpose of exemplification only with reference to the accompanying drawing, wherein:

DETAILED DESCRIPTION

To facilitate better understanding of the embodiments of the present disclosure, the technical solution according to the embodiments of the present disclosure will be described in detail in conjunction with the drawings. While certain embodiments have been described, these embodiments have been presented by way of examples only, and are not intended to limit the scope of the disclosure. Indeed, the novel embodiments described herein may be embodied in a variety of other forms; furthermore, various omissions, substitutions and changes in the form of the embodiments described herein may be made without departing from the spirit of the disclosure.

Figure 1:
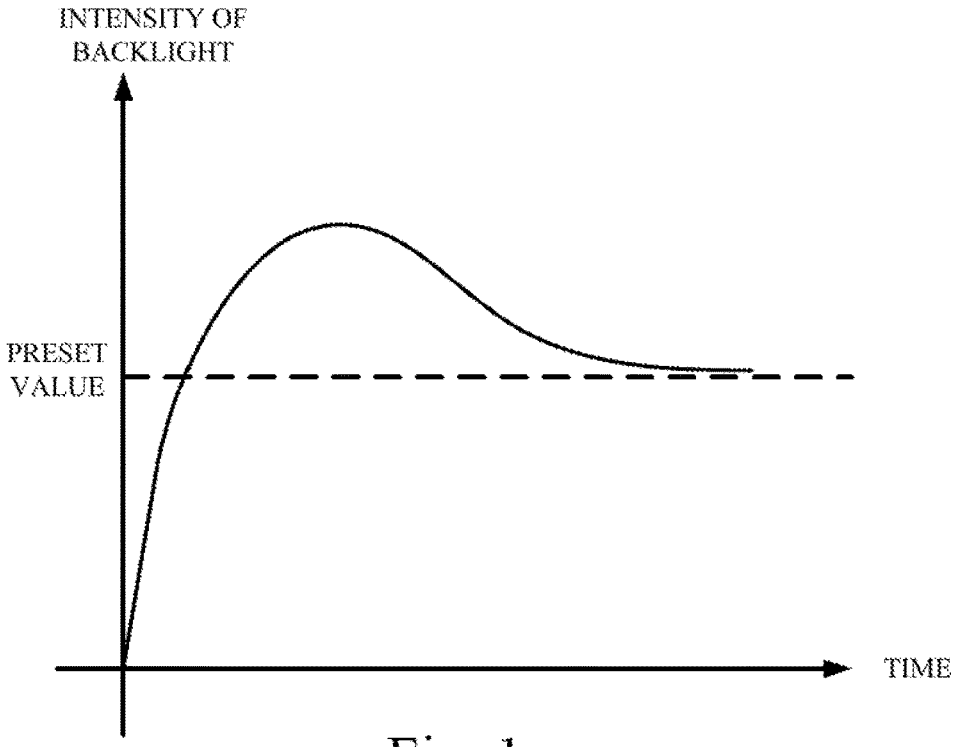
Fig. 1 (PRIOR ART)
FIG. 1 is a schematic curve graph of the intensity of back light of an existing back light module.
Figure 2:
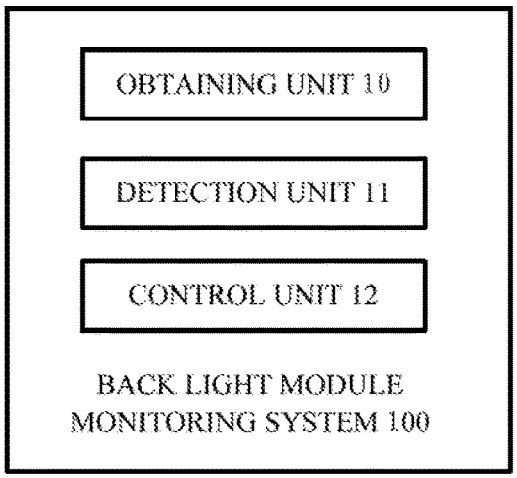
FIG. 2 is a schematic block diagram of the system for monitoring a back light module according to the first embodiment of the present disclosure.

FIG. 2 is a schematic block diagram of the system 100 for monitoring a back light module (hereinafter referred to as a back light module monitoring system) according to the first embodiment of the present disclosure. As shown in FIG. 2, the back light module monitoring system 100 may include an obtaining unit 10, a detection unit 11 and a control unit 12.

The obtaining unit 10 may obtain an intensity of output light from the back light module. In some embodiments of the present disclosure, the obtaining unit 10 may measure the intensity of the output light from the back light module. In some embodiments of the present disclosure, the obtaining unit 10 may receive the intensity of the output light from other measure apparatus which may measure the intensity of the output light from the back light module. The detection unit 11 may detect whether the intensity of the output light is greater than a preset value. The preset value herein may be defined as an intensity of light that enables a display panel using back light module as a light source to display image properly. Those skilled in the art will appreciate that the preset value may be set as needed. The control unit 12 may control the back light module to reduce the intensity of the back light in response to the intensity of the output light is greater than the preset value, such that the reduced intensity of the output light is equal to or greater than the preset value. In an embodiment of the present disclosure, the control unit 12 may send a control command to the back light module. Then the back light module may adjust the intensity of the output light based on the received control command, such that the reduced intensity of output light is equal to or greater than the preset value.

Figure 5:
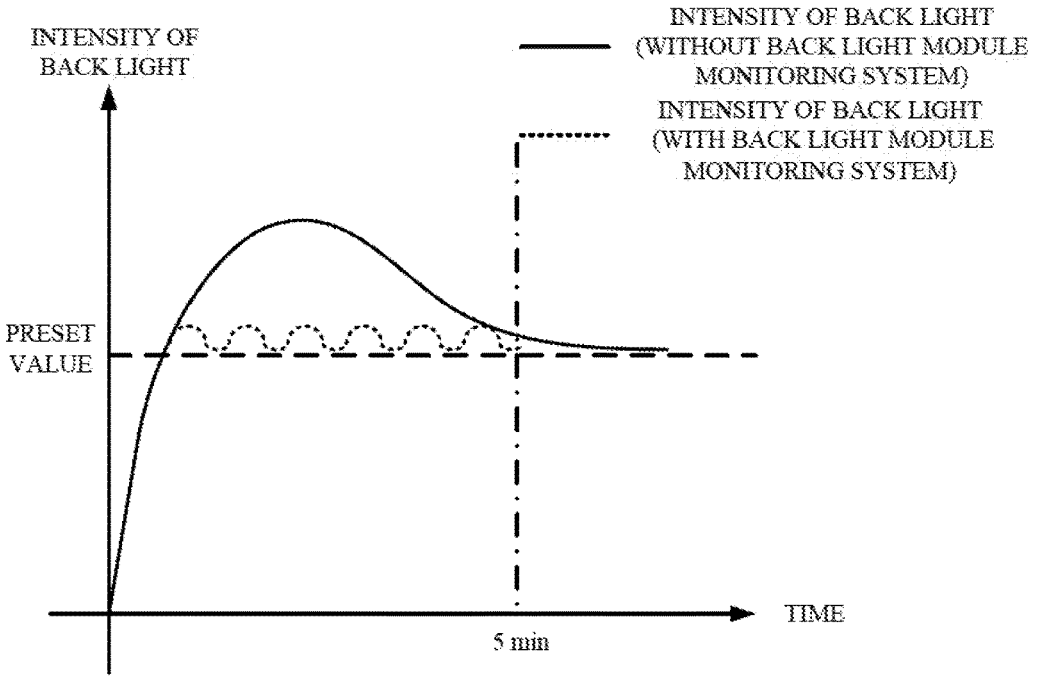
FIG. 5 is a schematic curve graph of the intensity of back light of the back light module to which the system for monitoring a back light module according to the embodiments of the present disclosure is applied.

In general, the display panel may display properly if the intensity of the output light from the back light module is close to the preset value. The back light module monitoring system 100 according to an embodiment of the present disclosure may control the back light module to reduce the intensity of the output light if the intensity of the output light from the back light module is greater than the preset value, so as to make the intensity of the output light close to the preset value, thereby avoiding the waste of the electric energy caused by the excess intensity of the output light from the back light module. Further, in some embodiments of the present disclosure, the detection unit 11 may detect whether the intensity of the output light is greater than the preset value at an interval of a preset period. Those skilled in the art will appreciate that the preset period may be set as needed. In some embodiments of the present disclosure, the preset period may be from 8 to 12 milliseconds. The periodic detection of the intensity of the output light can ensure that the difference between the electric energy saved by reducing the intensity of the output light and the electric energy consumed by the detection unit 11 is larger, so that the display panel consumes the electric energy as low as possible. In an example shown in FIG. 5, the preset period is set as 10 milliseconds.

Further, in some embodiments of the present disclosure, the detection unit 11 may detect whether the intensity of the output light is greater than the preset value within a preset time period since the back light module is activated.

Usually, the intensity of the output light from the back light module would reach and further beyond the preset value after a period of time since the back light module is activated. Thus, the waste of the electric energy occurs after this period of time. Therefore the detection unit 11 may only detect the intensity of the output light during the time of period in which the intensity of the output light is greater than the preset value, so as to reduce the energy consumed by the detection unit 11.

Figure 3:
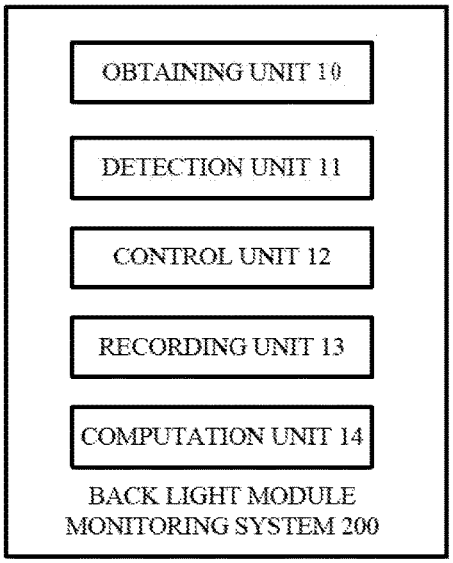
FIG. 3 is a schematic block diagram of the system for monitoring back light module according to the second embodiment of the present disclosure.

FIG. 3 is a schematic block diagram of the back light module monitoring system 200 according to the second embodiment of the present disclosure. In this embodiment, the back light module monitoring system 200 may determine a preset time period during which the detection unit 11 may perform the detection. As shown in FIG. 3, in addition to the obtaining unit 10, the detection unit 11 and the control unit 12, the back light module monitoring system 200 further includes a recording unit 13 and a computation unit 14. The recording unit 13 may record, after the back light module is activated, a first time point at which the intensity of the output light is equal to the preset value and a time duration in which the intensity of the output light is greater than the preset value. In an embodiment of the present disclosure, the recording unit 13 may do recording each time when the back light module is activated. The computation unit 14 may compute an average of the first time points and an average time duration based on the number of the recordings by the recording unit, the recorded first time points and time durations. In an embodiment of the present disclosure, the preset time period may be represented by the average of the first time points and the average time duration.

The back light module monitoring system 200 may record the time point at which the intensity of the output light is equal to the preset value and the time duration in which the intensity of the output light is greater than the preset value for many times for the back light module. For example, the back light module monitoring system 200 does recording N times. Then the time points at which the intensity of the output light is equal to the preset value are t1, t2, t3, . . . , tn, respectively, and the time durations in which the intensity of the output light is greater than the preset value are d1, d2, d3, . . . , dn, respectively. Therefore the average of the time points may be computed as (t1+t2+ . . . +tn)/N, and the average time duration may be computed as (d1+d2+ . . . +dn)/N. As such, the preset time period may be set as a period of (d1+d2+ . . . +dn)/N from the time points (t1+t2+ . . . +tn)/N after the back light module is activated.

The back light module monitoring system 200 may determine the preset time period for the different back light module.

Figure 4:
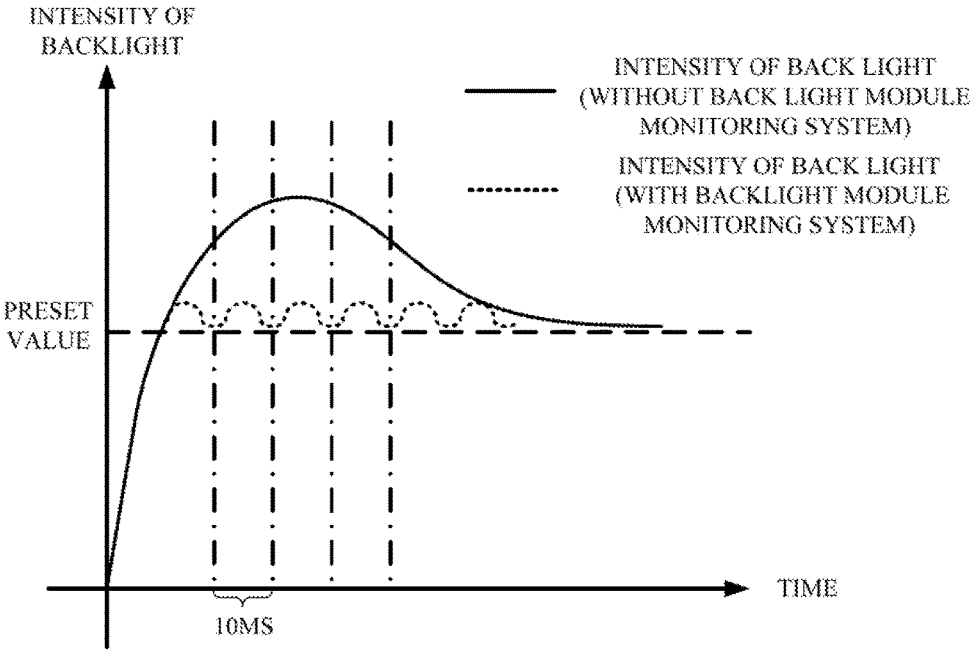
FIG. 4 is a schematic curve graph of the intensity of back light of the back light module to which the system for monitoring a back light module according to the embodiments of the present disclosure is applied.

Further, since the time length from the intensity of the output light beyond the preset value to the intensity of the output light close to the preset value is usually less than or equal to 5 minutes, in some embodiments of the present disclosure, the preset time period may be set as 5 minutes, as shown in FIG. 4. In other words, the preset time period may be set as a period of 5 minutes after the back light module is activated. As such, the adjustment to the excess intensity of the output light may be performed effectively, and the detection unit 11 does not consume too much electric energy.

In an embodiment of the present disclosure, there is provided a display apparatus, which includes the back light module monitoring system 100 or 200 as described above.

In some embodiments of the present disclosure, the display apparatus may be, for example, an electronic paper, a mobile phone, a tablet, a TV set, a laptop, a digital photo frame, a navigator or any other apparatus with display function.

Figure 6:
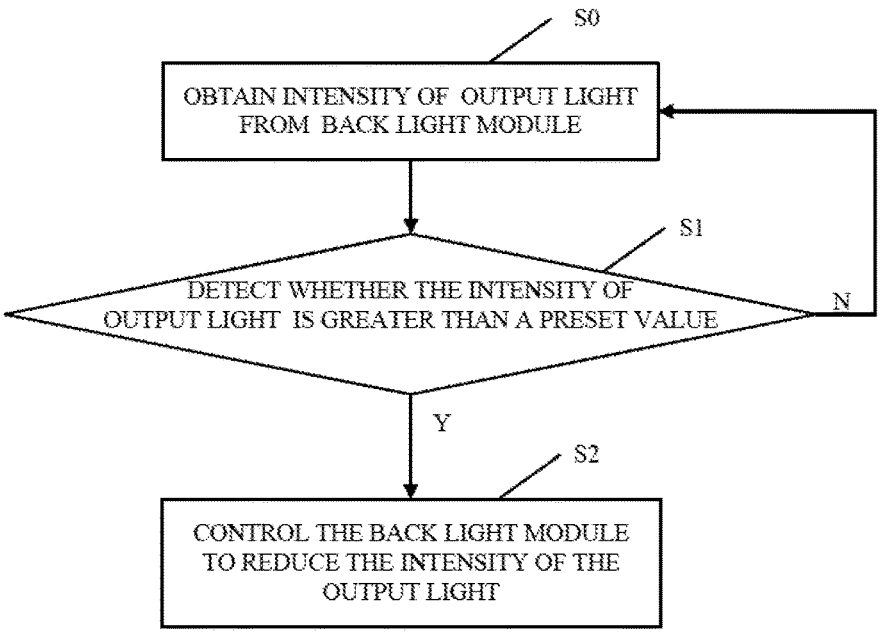
FIG. 6 is a schematic flow diagram of the method for monitoring a back light module according to an embodiment of the present disclosure.

FIG. 6 illustrates the method for monitoring a back light module according to an embodiment of the present disclosure. As shown in FIG. 6, in step S0, the intensity of the output light from the back light module is obtained. Then in step S1, it is detected whether the intensity of the output light is greater than the preset value. As described above, the preset value refers to the intensity of light that enables the display panel using the back light module as the light source to display image properly. In step S2, the back light module may be controlled to reduce the intensity of the back light in response to the intensity of output light is greater than the preset value, such that the reduced intensity of the output light is equal to or greater than the preset value. Further in step S1, it is detected whether the intensity of the output light is greater than a preset value at an interval of the preset period. In some embodiments of the present disclosure, the preset period may be from 8 to 12 milliseconds.

Further, in step S1, it is detected whether the intensity of the output light is greater than the preset value within a preset time period since the back light module is activated. In an embodiment of the present disclosure, before detecting whether the intensity of the output light is greater than the preset value, a first time point at which the intensity of the output light from the back light module is equal to the preset value and a time duration in which the intensity of the output light is greater than the preset value may be recorded after the back light module is activated. Then an average of the first time points and an average time duration may be computed based on the number of the recordings, the recorded first time points and time durations. In this case, the preset time period may be set as a period of the average time duration from the average of the first time points after the back light module is activated.

In an embodiment of the present disclosure, the preset time period may be set as 5 minutes. In this case, the preset time period may be set as a period of 5 minutes after the back light module is activated.

With the solutions of the embodiments of the present disclosure, when the intensity of the output light is greater than the preset value, the back light module may be controlled to reduce the intensity, so as to avoid outputting the light with excess intensity and wasting the electric energy.

The description above discusses example embodiments of the disclosure. It should be noted that those of ordinary skill in the art further may make, without departing from the principles of the disclosure, a number of improvements and variations, and these improvements and variations should also be considered to fall within the scope of the present invention.

What is claimed is:

1. A system for monitoring a back light module, comprising:

an obtaining unit configured to obtain a plurality of intensities of an output light from the back light module during a preset time period after the back light module is activated, wherein the preset time period is a fixed time period that is determined prior to activation of the back light module;

a detection unit configured to detect, for each of the plurality of intensities of output light, whether the intensity is greater than a preset value;

a control unit configured to control the back light module to reduce the intensity of the output light in response to detecting that the intensity of the output light is greater than the preset value, such that the intensity of the output light is equal to the preset value;

a recording unit configured to record, from when the back light module is activated, a first time point at which the intensity of the output light is equal to the preset value and a time duration during which the intensity of the output light is greater than the preset value; and a computation unit configured to compute, based on a number of recordings by the recording unit, the recorded first time points and time durations, an average of the first time points and an average time duration, wherein the preset time period is represented by the average of the first time points and the average time duration.

2. The system according to claim 1, wherein the obtaining unit is configured to obtain the intensities of output light at an interval having a preset period.

3. The system according to claim 2, wherein the preset period is from 8 to 12 milliseconds.

4. The system according to claim 1, wherein the preset time period is 5 minutes.

5. A display apparatus, comprising a back light module and a system for monitoring back light module according to claim 1.

6. A method for monitoring a back light module, comprising:

obtaining an intensity of an output light from the back light module;

detecting whether the intensity of the output light from the back light module is greater than a preset value;

controlling the back light module to reduce the intensity of the output light in response to detecting that the intensity of the output light is greater than the preset value, such that the intensity of the output light equal to the preset value;

wherein the obtaining, detecting and controlling operations are repeated during a preset time period after the back light module is activated, and wherein the preset time period is a fixed time period that is determined prior to activation of the back light module;

recording, from when the back light module is activated, a first time point at which the intensity of the output light from the back light module is equal to the preset value and a time duration in which the intensity of the output light is greater than the preset value; and computing, based on a number of recordings, the recorded first time points and time durations, an average of the first time points and an average time duration, wherein the preset time period is represented by the average of the first time points and the average time duration.

7. The method according to claim 6, wherein the obtaining is performed at an interval having a preset period.

8. The method according to claim 7, wherein the preset period is from 8 to 12 milliseconds.

9. The method according to claim 6, wherein the preset time period is 5 minutes.

* * * * *